US006545255B2

(12) United States Patent
Sato et al.

(10) Patent No.: US 6,545,255 B2
(45) Date of Patent: Apr. 8, 2003

(54) INDUCTION HEATING APPARATUS FOR HEATING IMAGE FORMED ON RECORDING MATERIAL

(75) Inventors: Takashi Sato, Tokyo (JP); Hiroshi Mano, Numazu (JP); Hajime Sekiguchi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 17 days.

(21) Appl. No.: 09/850,066

(22) Filed: May 8, 2001

(65) Prior Publication Data

US 2002/0005405 A1 Jan. 17, 2002

(30) Foreign Application Priority Data

May 10, 2000 (JP) ..... 2000-136685
Apr. 16, 2001 (JP) ..... 2001-116767

(51) Int. Cl.[7] ..... H05B 6/08; H05B 6/14

(52) U.S. Cl. ..... 219/619; 219/667; 399/330; 399/336

(58) Field of Search ..... 219/619, 667, 219/497, 494, 510, 216; 399/328, 329, 330, 335, 336

(56) References Cited

U.S. PATENT DOCUMENTS

| | | | | |
|---|---|---|---|---|
| 4,013,872 A | * | 3/1977 | Glass | 219/497 |
| 4,556,779 A | * | 12/1985 | Hashimoto et al. | 219/471 |
| 4,970,219 A | | 11/1990 | Effland et al. | 514/349 |
| 5,148,226 A | | 9/1992 | Setoriyama et al. | 355/290 |
| 5,149,941 A | | 9/1992 | Hirabayashi et al. | 219/216 |
| 5,161,364 A | * | 11/1992 | Bruun et al. | 60/39.02 |
| 5,278,394 A | * | 1/1994 | Morino | 219/497 |
| 5,373,141 A | * | 12/1994 | Ko | 219/497 |
| 5,525,775 A | | 6/1996 | Setoriyama et al. | 355/282 |
| 5,752,148 A | * | 5/1998 | Yoneda et al. | 399/329 |
| 5,798,502 A | * | 8/1998 | Comer | 219/497 |
| 5,801,359 A | | 9/1998 | Mano et al. | 219/618 |
| 5,811,764 A | * | 9/1998 | Hirst | 219/497 |
| 5,819,150 A | | 10/1998 | Hayasaki et al. | 399/320 |
| 5,865,762 A | * | 2/1999 | Savourey et al. | 600/519 |
| 5,940,655 A | | 8/1999 | Sano et al. | 399/67 |
| 6,118,105 A | * | 9/2000 | Berkcan et al. | 219/497 |
| 6,147,457 A | * | 11/2000 | Lohn et al. | 315/224 |
| 6,246,843 B1 | | 6/2001 | Nanataki et al. | 399/320 |

FOREIGN PATENT DOCUMENTS

| | | |
|---|---|---|
| JP | 63-313182 | 12/1988 |
| JP | 01-263679 | 10/1989 |
| JP | 02-157878 | 6/1990 |
| JP | 4-44075 | 2/1992 |
| JP | 04-044076 | 2/1992 |
| JP | 04-044077 | 2/1992 |
| JP | 04-044078 | 2/1992 |
| JP | 04-044079 | 2/1992 |
| JP | 04-044080 | 2/1992 |
| JP | 04-044081 | 2/1992 |
| JP | 04-044082 | 2/1992 |
| JP | 04-044083 | 2/1992 |
| JP | 04-204984 | 7/1992 |
| JP | 7-319312 | 12/1995 |

* cited by examiner

*Primary Examiner*—Philip H. Leung
(74) *Attorney, Agent, or Firm*—Fitzpatrick, Cella, Harper & Scinto

(57) ABSTRACT

In a heating apparatus of magnetic induction heating type for heating an image formed on a recording material, there are generated an unevenness and a ripple in a temperature on the surface of a fixing roller, leading to the deterioration of fixing ability. This is caused by in accurate temperature detection by induction noise components such as a noise resulting from an alternating magnetic field generated by an excitation coil. The purpose of the present invention is to provide an induction heating apparatus capable of temperature control satisfactory accuracy.

7 Claims, 8 Drawing Sheets

RC INTEGRATION CIRCUIT

RL INTEGRATION CIRCUIT

INDUCTION HEATING APPARATUS FOR HEATING IMAGE FORMED ON RECORDING MATERIAL

BACKGROUND OF THE INVENTION

1. Field of the Invention

The present invention relates to a heating apparatus of induction heating type for heating an image formed on a recording material.

2. Related Background Art

In an image forming apparatus such as a printer, a copying apparatus or a facsimile apparatus, there is widely employed a heating apparatus of contact heating type such as heat roller type, film heating type or magnetic induction heating type, as an image heating apparatus represented by a heat fixing apparatus for fixing, to a recording material to be heated such as a transfer sheet, a printing sheet, a photosensitive (electrofax) sheet or an electrostatic recording sheet, an unfixed visible image (unfixed toner image), formed by an appropriate image forming process such as an electrophotographic process, an electrostatic recording process or a magnetic recording process on such recording material to be heated and borne thereon by a transfer (indirect) method or a direct method.

The heating apparatus of heat roller type is basically composed of a pair of rollers consisting of a heat roller (fixing roller) heated and regulated to a predetermined temperature by a heat source such as a halogen lamp and a pressure roller maintained in pressure contact therewith, and the material to be heated is introduced into and conveyed in the contact nip (fixing nip) of the rollers whereby the unfixed visible image on the material to be heated is fixed thereto by the heat of the heat roller.

Also the heating apparatus of the film heating type is disclosed for example in the Japanese Patent Applications Laid-open Nos. 63-313182, 1-263679, 2-157878, 4-44075, 4-44075 to 4-44083; and 4-20498 to 4-204984 and is commercially used.

In such heating apparatus, the material to be heated is maintained in contact with a heating body fixedly supported by a support member across a thin heat-resistant film material (fixing film) and the film material is made to slide over the heating body thereby giving the heat of the heating body to the material to be heated across the film material. The heating body can be composed of so-called ceramic heater, basically composed of a ceramic substrate (hereinafter simply called substrate) of sufficient heat resistance, electrical insulation and heat conductivity such as alumina ($Al_2O_3$) or aluminum nitride (AlN) and a resistance layer formed on the surface of the substrate and capable of generating heat by electric current supply. Also the film material can be composed of a thin film of a low heat capacity. Therefore, in comparison with the heating apparatus of heat roller type, the heating apparatus of film heating type has a higher heat transmitting efficiency and a faster start-up, thereby enabling reduction of the waiting time (quick starting property or on-demand operability) and electric power saving.

Also in the image heating apparatus of magnetic induction heating type, as disclosed in the Japanese Patent Application Laid-open No. 7-319312, it is proposed to generate an eddy current in a metal core of the fixing roller by an alternating magnetic field, thereby generating Joule's heat by magnetic induction in such metal core namely in the fixing roller.

As shown in FIG. 8, there are shown a cylindrical heating roller 1 provided rotatably in a direction a by an unrepresented driving source. and a pressure roller 2 maintained in pressure contact with the heating roller 1 and rotated by the rotation thereof. Inside the heating roller 1, there is provided a coil assembly 3 for generating an induction magnetic field. The pressure roller 2 is provided with a silicone rubber layer 6 around a shaft core 4. There are shown a thermistor 6 serving as a temperature sensor for detecting the surface temperature of the heating roller 1, and a separating claw 7 for separating sheet from the heating roller 1.

In the coil assembly 3, a square-shaped bobbin 8 with an aperture in the center is wound with a copper wire by plural turns in a single direction to constitute an excitation coil 9, and a core 10 is inserted into the central aperture 8*a* of the bobbin 8 in a direction perpendicular to the copper wire of the excitation coil 9. The coil assembly 3 is so positioned that the copper wire wound on the bobbin 8 extends along a plane parallel to the rotary axis of the heating roller 1, namely that the core 10 is perpendicular to the rotary axis, thereby generating magnetic flux in a direction perpendicular to the rotary axis of the heating roller 1.

Plural coil assemblies 3 are arranged along the axial direction of the heating roller 1 by means of a holder 11 in such a manner that the core is parallel to the conveying direction of the sheet and an end of the excitation coil 9 is opposed to the pressure roller 2 while the other end of the coil 9 is opposed to the thermistor 6. The holder 11 is composed of a heat-resistant plastic material, and has a diameter somewhat smaller than the internal diameter of the heating roller 1 in order to form a gap to the internal wall of the heating roller 1.

FIG. 9 is a block diagram of a circuit for supplying the induction heating coil 9 with a high frequency current thereby controlling the temperature of the heating roller 1. The AC current of a commercial power source 13 is rectified by a rectifying circuit 14 and is converted by an inverter circuit 20 into the high frequency current. The current to the inverter circuit 20 is supplied through a thermostat 15 constituting a temperature fuse maintained in contact with the surface of the heating roller 1.

The thermostat 15 serves to cut off the current supplied to the circuit when the surface temperature of the heating roller 1 reaches a predetermined abnormal temperature, and is provided, like the thermistor 6, in a position opposed to the excitation coil 9 wound on the core 10. A control circuit 16 is composed of a microprocessor, a memory etc., and provides a drive circuit 21 in the inverter circuit 20 with an on/off signal while monitoring the temperature of the heating roller 1 based on a potential corresponding to the temperature detected by the thermistor 6, thereby executing temperature control.

In the inverter circuit 20, when the control signal from the control circuit 16 is turned on, the drive circuit 21 turns on a switching element 22 consisting for example of a transistor, an FET or an IGBT thereby providing the excitation coil 9 with a current.

On the other hand, a current detecting circuit 22, upon detecting that the current reaches a predetermined current value IP, sends a signal to the drive circuit 21 so as to turn off the switching element 22. When the switching element 22 is turned off, a resonance current is generated between the excitation coil 9 and a resonance capacitor 24. Then, upon detecting that the voltage V of the switching element 22 at the side of the excitation coil 9 is lowered to about 0 V by the resonance, a voltage detecting circuit 25 sends a signal to the drive circuit 21 so as to turn on again the switching element 22.

In the heating apparatus of magnetic induction heating type of the above-described configuration, the temperature control at the heating position (nip portion) for the material to be heated is executed by employing a thermistor as the temperature detecting element, detecting the temperature by positioning such thermistor in contact with the surface or internal surface of the roller body or the film member constituting the heating body for the material to be heated (contact type temperature detection) and controlling the electric power supply from the driving power source to the excitation coil 9 by the control circuit 16 based on the information of such temperature detection, thereby maintaining the temperature of the heating portion of the material to be heated at a predetermined value.

In such configuration, however, the exact temperature detection is hindered since the temperature detection signal outputted from the thermistor functioning as the temperature detecting element is superposed with induction noise components such as a noise resulting from the alternating magnetic field generated by the excitation coil serving as the magnetic field generating means and a switching noise resulting from the inverter circuit. As a result, there are generated an unevenness and a ripple in the temperature on the surface of the fixing roller, leading to the deterioration of the fixing ability.

SUMMARY OF THE INVENTION

In consideration of the foregoing, an object of the present invention is to provide an induction heating apparatus capable of temperature control of satisfactory accuracy.

Another object of the present invention is to provide an induction heating apparatus capable of providing a satisfactory precision in the signal entered from a temperature detecting element to temperature control means.

Still another object of the present invention is to provide an induction heating apparatus capable of eliminating noises from the signal entered from a temperature detecting element to temperature control means.

Still another object of the present invention is to provide an induction heating apparatus comprising:

a heating member;

an excitation coil for generating a magnetic field to induce an eddy current in the heating member;

a temperature detecting element for detecting the temperature of the heating member; and control means for controlling an electrical supply to the excitation coil in accordance with the temperature detected by the temperature detecting element;

wherein the output of the temperature detecting element is inputted into the control means through a band-pass filter.

Still other objects of the present invention, and the features thereof, will become fully apparent from the following detailed description which is to be taken in conjunction with the accompanying drawings.

DETAILED DESCRIPTION OF THE PREFERRED EMBODIMENTS

First Embodiment (1) Image Forming Apparatus

Figure 1:
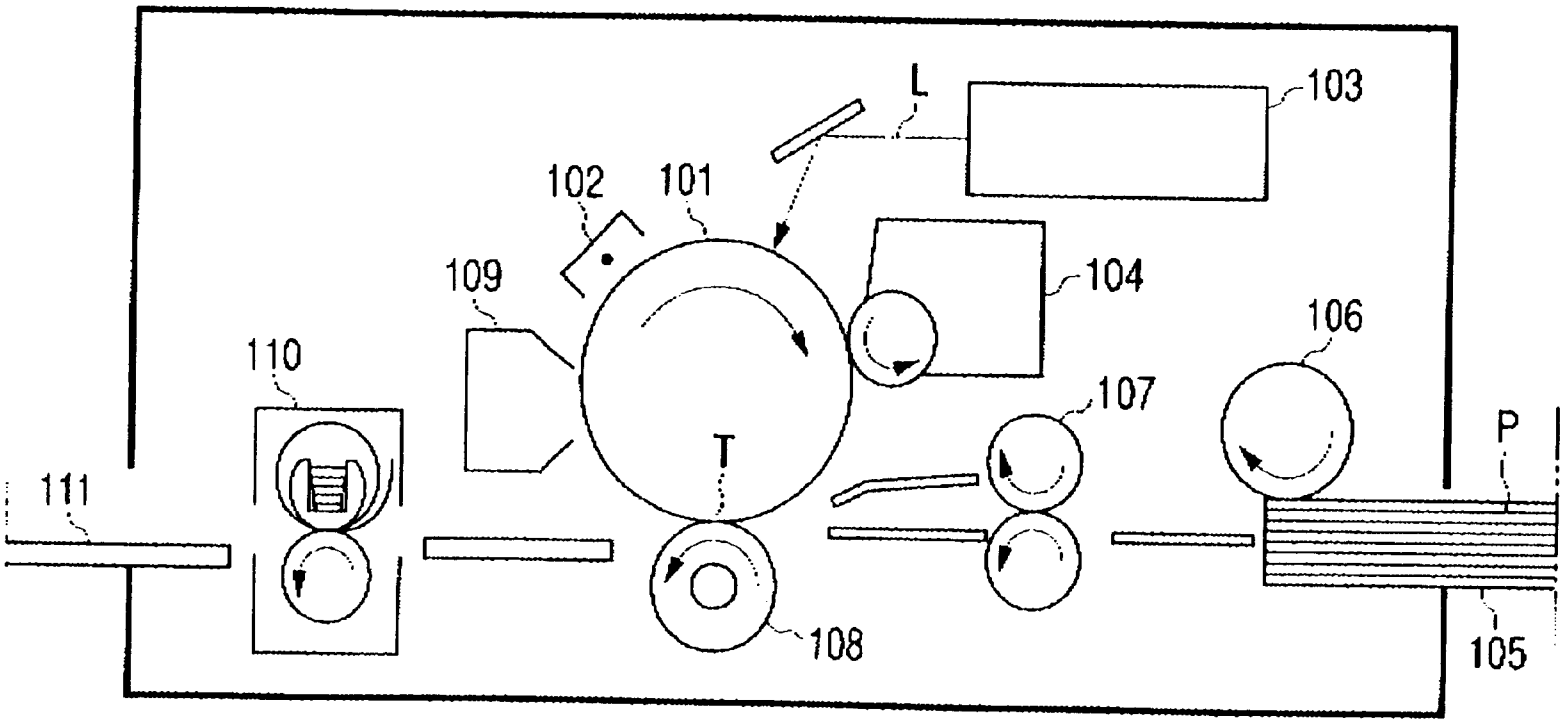
FIG. 1 is a schematic view showing the configuration of an example of an image forming apparatus in a first embodiment of the present invention.

FIG. 1 is a schematic view showing the configuration of an image forming apparatus of the present embodiment, which is a laser beam printer utilizing an electrophotographic process. Referring to FIG. 1, an electrophotographic photosensitive body 101 of rotary drum shape (hereinafter called photosensitive drum) serving as an image bearing body Is rotated clockwise, as indicated by an arrow, with a predetermined peripheral speed (process speed), and, in the course of rotation, it is charged uniformly at a predetermined polarity and a predetermined potential by a primary charging device 102.

A laser beam scanner 103 outputs a laser beam L modulated according to time-sequential electric digital pixel signals of a desired image information entered from an unrepresented host apparatus such as a host computer, a word processor or an image reading apparatus thereby scanning, with such laser beam L, the surface of the rotary photosensitive drum 101 uniformly charged by the primary charging device 102 as explained above to form an electrostatic latent image corresponding to the desired image information on the surface of the photosensitive drum 101. Such electrostatic latent image is normal or reversal developed as a toner image by a developing device 104.

On the other hand, a material to be heated (recording medium) P stacked on a sheet feeding tray 105 is fed one by one by a feeding roller 106, then passed by paired registration rollers 107, further conveyed to a transfer nip portion T, which is the contact portion of the rotary photosensitive drum 101 and a transfer roller (transfer device) 108 maintained in contact therewith and supplied with a transfer bias voltage, with a suitable control timing synchronized with the rotation of the photosensitive drum 101, and pinched and conveyed in such transfer nip portion T whereby the toner image on the rotary photosensitive drum 101 is transferred in succession onto the surface of the material P to be heated.

The material P to be heated, after passing the transfer nip portion T, is separated from the surface of the rotary photosensitive drum 101, then introduced into a fixing device (fixing unit) 110 of magnetic induction heating type for the fixation of the transferred toner image, and is discharged as a formed image product (print) onto a discharge tray 111. After the separation of the material P to be heated, the surface of the rotary photosensitive drum 101 is cleaned by the removal of remnants on the photosensitive drum such as remaining toner in a cleaning device 109, and is used again for image formation.

Figure 2:
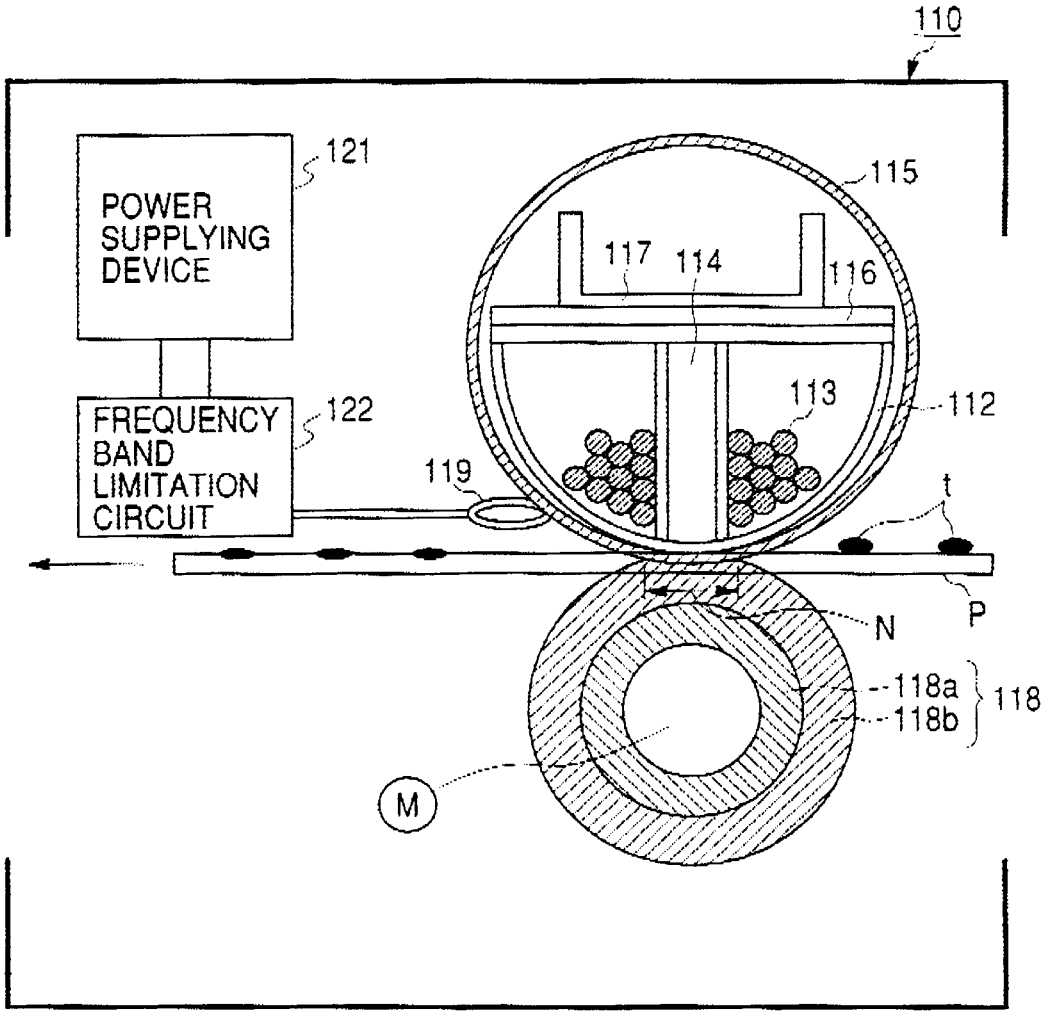
FIG. 2 is a schematic cross-sectional view of a heat fixing apparatus in the above-mentioned image forming apparatus.

The fixing device 110 is based on a magnetic induction heating system of the present invention utilizing a magnetic induction heat-generating film (metal film), and FIG. 2 is a schematic magnified cross-sectional view of the fixing device 110 utilizing such heating system.

Referring to FIG. 2, a film internal surface guide stay 112 having an upward concave semicircular cross section is composed for example of liquid crystal polymer or phenolic resin, and is provided therein with an excitation coil (heating coil) 113, and a core material (excitation core, iron core)) 114. On the outside of the film internal surface guide stay 112, there is loosely fitted a magnetic induction heat-generating film (hereinafter simply called film) 115 of a cylindrical (endless belt) shape. There are also provided a cover plate 116 fitted on the upper aperture of the film internal surface guide stay 112 and a pressurizing stay 117 provided on the cover plate 116.

A pressure roller 118 is composed of a metal core 118*a* and an elastic layer 118*b* provided therearound and composed for example of silicone rubber or fluorinated rubber, and is maintained in contact, with a predetermined pressing force, with the lower surface of the film internal surface guide stay 112 across the film 115. Such contact portion constitutes a fixing nip portion N.

The pressure roller 118 is rotated counterclockwise, as indicated by an arrow. by drive means M (pressure roller drive system). As the pressure roller 118 is rotated, the frictional force between the pressure roller 118 and the film 115 causes a rotary force on the film 115 at the fixing nip portion N, whereby the film 115 rotates along the external periphery of the stay 112 and in contact with the lower surface thereof at the fixing nip portion N. For achieving smooth rotation of the film 115, a lubricant such as grease or oil is preferably employed between the lower surface of the stay 112 and the internal surface of the film 115.

Figure 3:
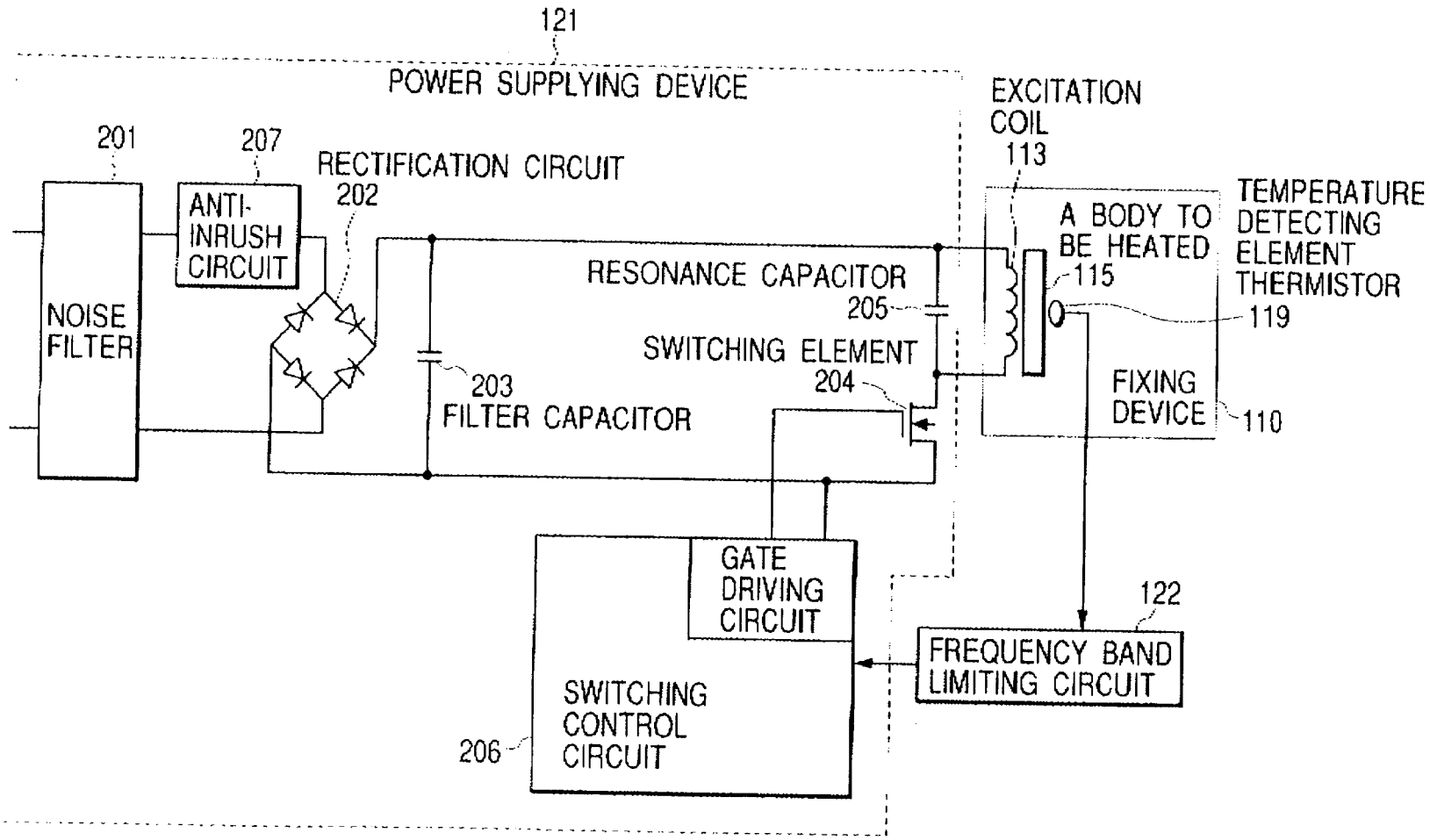
FIG. 3 is a circuit diagram of a power supply device.

A thermistor 119 constituting temperature detection means is provided in a position of the film internal surface guide stay 112 close to the fixing nip portion N. A power supply device (excitation circuit, high frequency power supply device) 121 for providing the excitation coil 113 with a high frequency current is composed, as shown in FIG. 3, of a noise filter 201 connected to an unrepresented power source, an anti-inrush circuit (surge prevention circuit) 207 provided at the output side of the noise filter 201, a rectification circuit 202 for rectifying the output of the anti-inrush circuit 207, a filter capacitor 203 connected parallel to the rectification circuit 202, an excitation coil 113 receiving electric power supply from the rectification circuit 202, a switching element 204 connected serially to the excitation coil 113, a resonance capacitor 205 connected parallel to the excitation coil 113, and a switching control circuit 206 for controlling the switching element 204 in response to a temperature detection signal, thereby supplying the excitation coil 113 with a high frequency AC current of 20 to 800 kHz.

Figure 6:
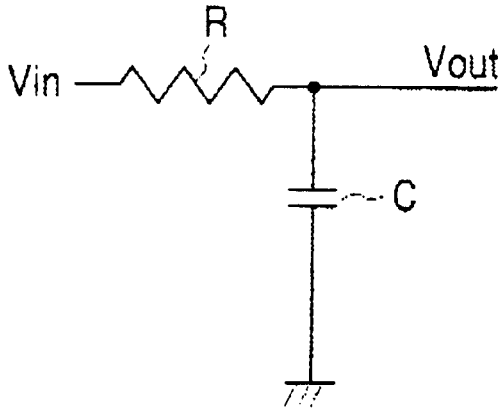
FIGS. 6 and 7 are circuit diagrams of a frequency band limiting circuit.
Figure 7:
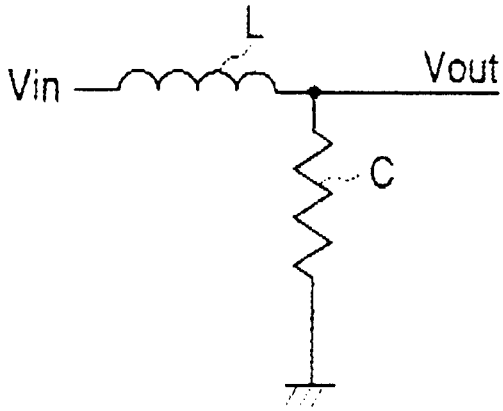
Figure 8:
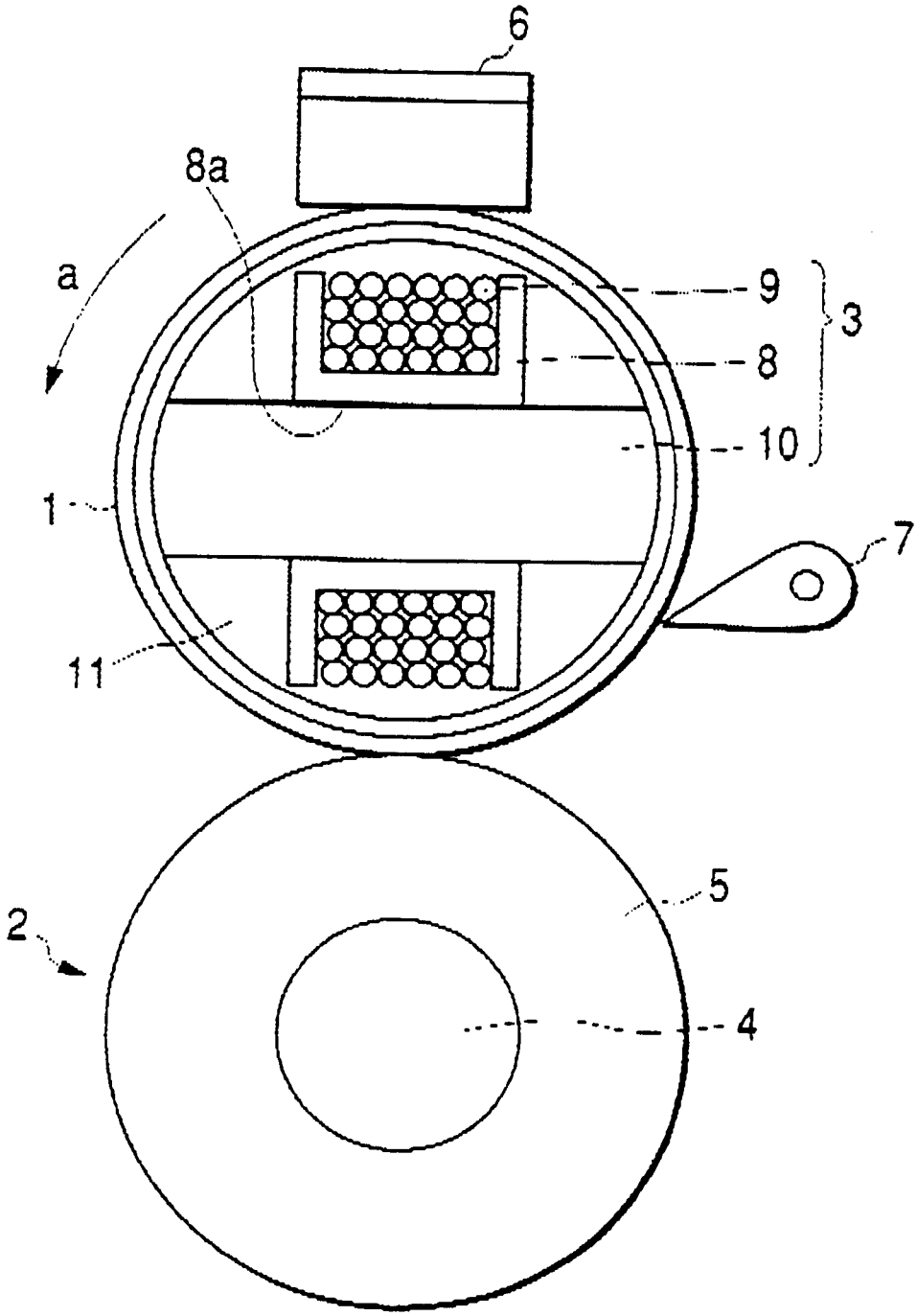
FIG. 8 is a schematic view of a conventional heat fixing apparatus.
Figure 9:
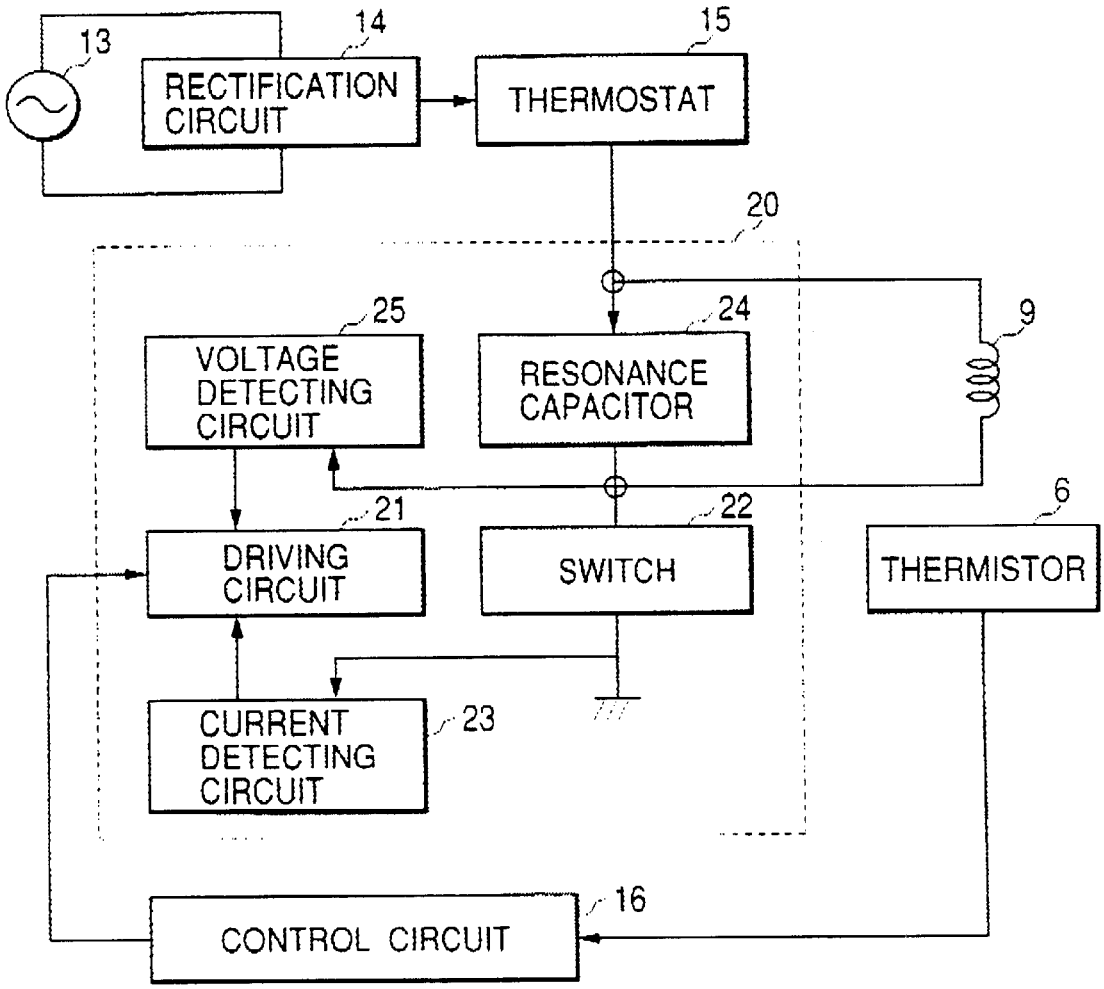
FIG. 9 is a block diagram of a conventional power supply circuit.

A frequency band limiting circuit 122 eliminates a noise component superposed with a temperature signal detected by the thermistor 119 and having the drive frequency of the power supply device 121 which supplies the excitation coil 113 with the high frequency current. Since the drive frequency of the power supply device 121 has a higher frequency of 20 to 800 kHz in comparison with that of the temperature detection signal detected by the thermistor 119, the frequency band limiting circuit 122 can be composed of a low pass filter such as an RC integrating circuit as shown in FIG. 6 or an RL integrating circuit as shown in FIG. 7, with such a constant as to cut off the switching noise component emitted or transmitted from the drive frequency of the power supply device 121. As shown in FIG. 3, the output of the frequency band limiting circuit 122 is supplied to the switching control circuit 206. There is also shown a fixing device 110.

Figure 4:
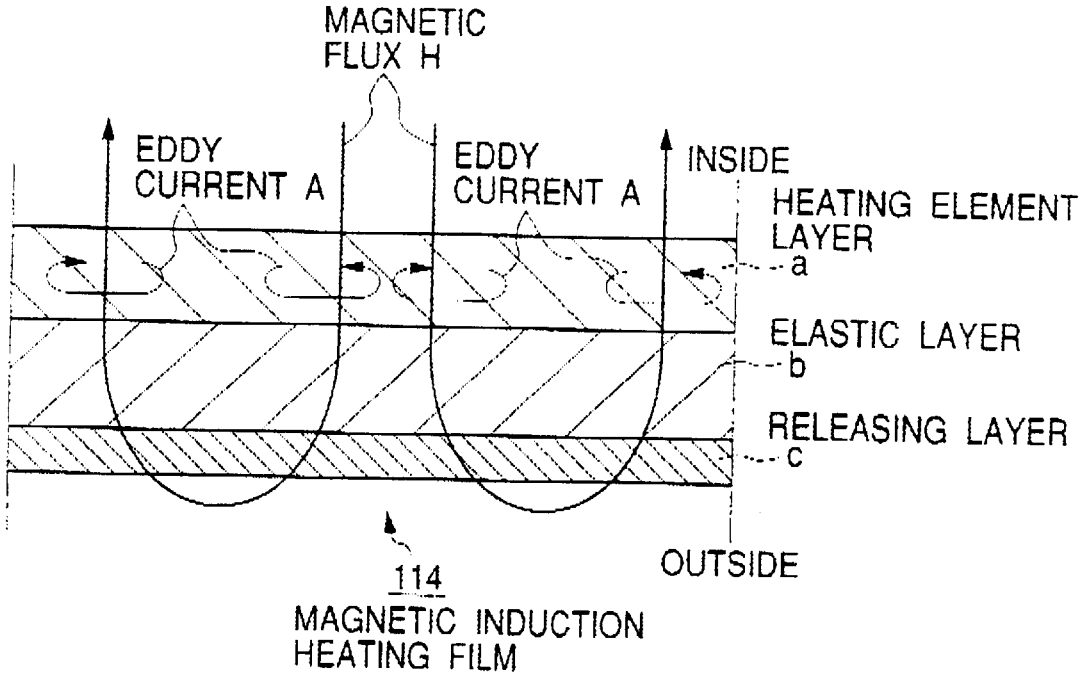
FIG. 4 is a schematic view showing the layered configuration of a magnetic induction heat-generating film.

FIG. 4 is a schematic view showing the layered configuration of the magnetic induction heat-generating film. The film 115 has a three-layered structure having, in succession from the inside to the outside, a heating element layer (magnetic induction heat-generating layer) a composed of a magnetic metal, a metal or a magnetic material, an elastic layer b and a releasing layer c.

The heating element layer a is formed for example by a layer of iron or cobalt, or a metal layer of nickel, copper or chromium obtained by plating, with a thickness of 1 to 100 $\mu$m.

The elastic layer b is composed for example of a silicone rubber layer of a thickness of 50 $\mu$m, and causes the surface of the film 115 to accommodate the surface irregularity of the toner layer even in case of a color toner image of a large thickness composed of four superposed color toners.

The releasing layer c is composed of a single material or a mixture of heat-resistant resin with satisfactory toner releasing property such as PFA, PTFE, FEP or silicone resin.

Also the layered structure of the film 115 may be suitably selected such as a single-layered structure in which the heating element layer a is composed of a single film, or a two-layered structure composed of a base film of heat-resistant resin such as polyimide, polyamide, PEEK, PES, PPS, PEA, PTFE or FEP of a thickness of 10 to 100 $\mu$m and a heating element layer a, or a three-layered structure further provided with a releasing layer.

In response to the application of a high frequency current from the power supply device 121 to the excitation coil 113, the heating element layer a of the film 115 generates heat by magnetic induction, principally in an area of the fixing nip portion N. The application of the high frequency current from the power supply device 121 to the excitation coil 113 repeatedly generates and annulates a magnetic flux indicated by an arrow H around the excitation coil 113. The magnetic flux H crosses the heating element layer a of the film 115, and the varying magnetic field crossing the heating element layer a composed of a magnetic material therein generates an eddy current A thereby generating a magnetic filed so as to hinder the variation of the magnetic field.

The eddy current A is almost concentrated at a surface of the heating element layer a at the side of the excitation coil 113 because of the skin effect, thereby generating heat (Joule's heat) with an electrical power proportional to the surface resistance of the heating element layer a. Then the temperature of the fixing nip portion N, constituting the heating position for the material to be heated, is detected by the thermistor 119 and the detected temperature information is entered into the control circuit of the power supply device 121 whereby the high frequency current supplied from the power supply device 121 to the excitation coil 113 is so controlled that the fixing nip portion N reaches a predetermined fixing temperature.

Then, in a state where the film 115 is rotated by the rotation of the pressure roller 118 and the heating element layer a of the film 115 is heated and temperature controlled by magnetic induction heating principally in the area of the fixing nip portion N, the material P to be heated and bearing an unfixed toner image t is inserted between the film 115 and the pressure roller 118 in the fixing nip portion N and passes the fixing nip portion N together with the film 115 and in contact with the external surface thereof, whereby the unfixed toner image t is fixed to the material P by the heat from the heating element layer a of the film 115 and the pressure therefrom. After passing the fixing nip portion N, the material P to be heated is separated from the rotating film 115 by the curvature thereof.

Figure 5:
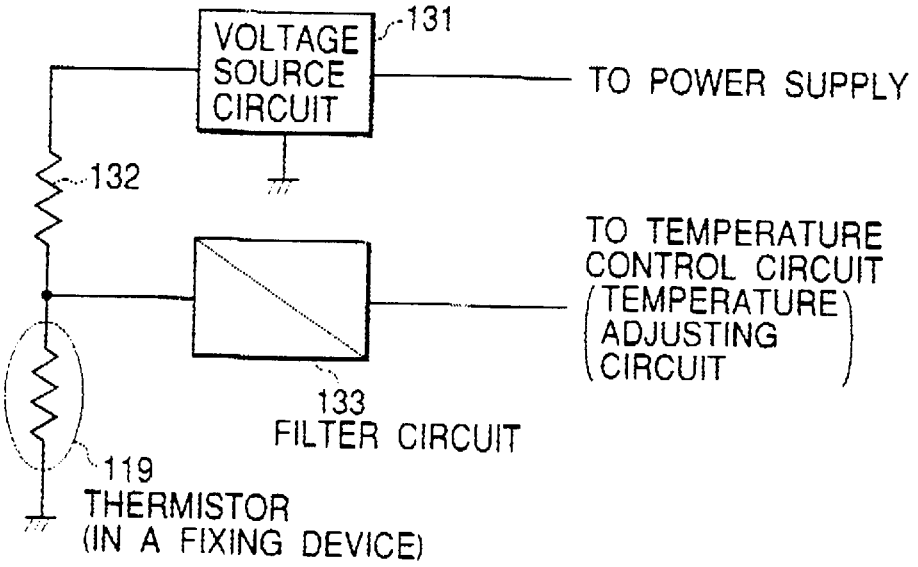
FIG. 5 is a circuit diagram of a temperature detecting circuit.

The thermistor 119 constituting the temperature measurement means is maintained In contact with the internal surface of the film 115 as shown in FIG. 2 and measures the temperature in the vicinity of the fixing nip, An example of the circuit therefor is composed, as shown in FIG. 5, of a serial circuit of a voltage source circuit 131. a resistor 132 and the thermistor 119, in which a change in the resistance of the thermistor 119 by the temperature is detected as voltage information from a filter circuit 133 for supply to a temperature control circuit. In such temperature control circuit, for example it is composed of an analog circuit, the control parameter is determined by an operational amplifier and a feedback circuit.

Figure 10:
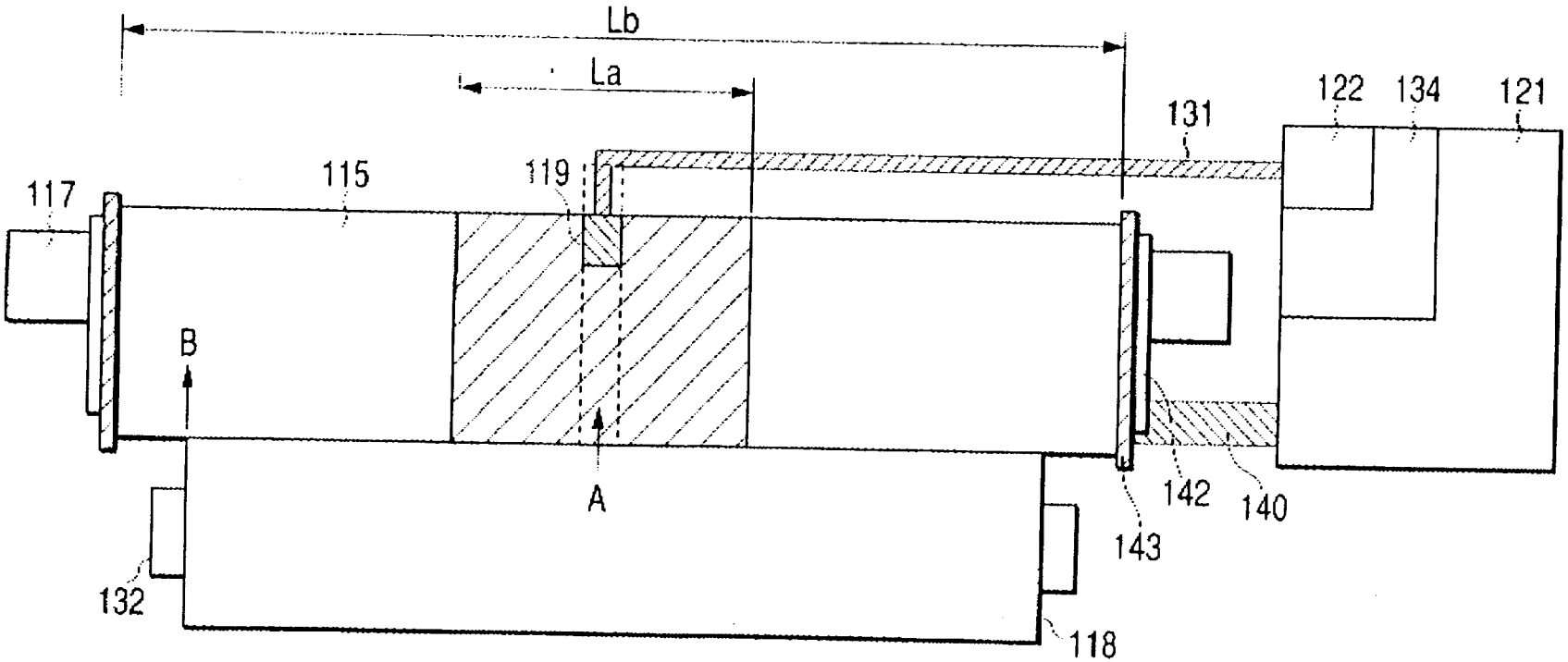
FIG. 10 is a schematic view showing the configuration in the longitudinal direction of a heating apparatus.

FIG. 10 is a longitudinal elevation view of the heating apparatus. The thermistor 119 for detecting the temperature change in the hollow magnetic induction heating member 115 is positioned within an area of the minimum width La of the unfixed image to be passed by the heating apparatus, and to be determined in advance as shown in FIG. 10.

FIG. 10 shows a case where the unfixed image is passed taking, as the reference position, the center A of the hollow magnetic induction heating member in the longitudinal direction thereof, but, also in case an end position B is taken as the reference position, the thermistor 119 has to be positioned within the area of the minimum width of the unfixed image to be passed by the heating apparatus.

The thermistor 119 Is maintained in sliding contact with the external or internal surface of the film member or the rigid roller member constituting the hollow magnetic induction heating member, as shown in FIG. 10.

The frequency band limiting circuit 122 and the thermistor 119 are connected by signal lines 141 covered with heat-resistant and insulating resin, and the connecting signal lines 141 are composed of a twisted cable in which the lines mutually cross at least once for reducing the influence of induction or electrostatic capacitance coupling. The signal lines are fixed for example to a frame with a heat insulating structure, not illustrated in FIG. 10 but covering the heating apparatus, and are extended to the frequency band limiting circuit 122.

The temperature detection signal filtered by the frequency band limiting circuit 122 is entered into a temperature control circuit 134, and, in response to such signal, the control circuit controls the power supply device 121 to maintain the heating portion at a constant temperature.

There are also shown a power supply line 140 to the excitation coil, and flanges 142 fixed in parallel on left and right ends the film guide member 143 and the assembly thereby limiting the ends of the magnetic induction heating member 115. A metal core 132 of the pressure roller is fixed to an unrepresented motor frame.

In the present first embodiment, as explained in the foregoing, the noise component superposed with the temperature detection signal outputted from the thermistor is superposed by induction or electrostatic capacitance coupling with the signal line, so that the use of the twisted cable for the signal line allows to minimize the noise component superposed with the temperature detection signal.

Also the frequency band limiting circuit 122, being positioned outside the width Lb of the heat generating area of the hollow magnetic induction heating member, can filter off all the noise components such as a noise resulting from the alternating magnetic field generated by the excitation coil constituting magnetic field generating means, a switching noise generated by the inverter circuit, a noise generated by the electrostatic coupling through the hollow magnetic induction heating member.

Also the frequency band limiting circuit 122 and the temperature control circuit 134 are mounted on a board of the driving power source as shown in FIG. 10, thereby reducing the connectors for the circuit boards and the number of components.

In the first embodiment, as explained in the foregoing, the temperature detection signal outputted for example from the thermistor is supplied through the frequency band limiting circuit to the switching control circuit serving as the temperature control means, in order to eliminate the noise components superposed on the temperature detection signal, whereby the temperature detection can be exactly executed without being influenced by the switching noise from the inverter circuit or the noise resulting from the alternating magnetic field, thereby achieving exact temperature control of the heating position for the material to be heated.

Other Embodiments

1) The fixing film 115 constituting the magnetic induction heating member is naturally not limited to the layered configuration shown in the first embodiment, and may be composed of a film member solely constituted by the magnetic induction heating layer or a film member in which desired functional layer such as releasing layer, elastic layer, heat insulating layer etc. are arbitrarily combined.

2) The magnetic induction heating member may also be formed as a rigid roller body.

3) The heating apparatus of magnetic induction heating type may also be formed by employing a fixed magnetic induction heating member, moving a heat resistant film in sliding contact with such fixed magnetic induction heating member and causing the magnetic inducting heating member to generate heat by magnetic induction by a magnetic field from magnetic field generation means, thereby heating the material to be heated by the heat from the magnetic induction heating member across a film material, and the present invention is likewise applicable to such heating apparatus.

4) The pressure member may also be made capable of magnetic induction heat generation (two-side heating system), and such configuration is effective as the heat fixing apparatus for a color image formed by superposing plural color toner layers.

5) The heating apparatus of the present invention is applicable not only as an image heat fixing apparatus for use in the Image forming apparatus of the embodiment or the like but also as a heat treating apparatus for various applications such as an apparatus for heating an image-bearing material thereby improving the surface properties such as gloss, an apparatus for temporarily fixing an image, or an apparatus for drying or thermally laminating a sheet-shaped member.

The present invention is not limited to the foregoing embodiments but is subject to various modifications within the scope and spirit of the appended claims.

What is claimed is:

1. An induction heating apparatus for heating an image formed on a recording material, comprising:

a high frequency current generating means for generating a high frequency current;

an excitation coil to which the high frequency current generated by the high frequency current generating means is applied, for generating a magnetic field;

a heating member having an endless metal member in which an eddy current is induced by the magnetic field generated by said excitation coil;

a temperature detecting element for detecting the temperature of said heating member;

control means for controlling an electrical supply to said excitation coil in accordance with the temperature detected by said temperature detecting element; and a band-pass filter connected between said temperature detecting element and said control means, wherein said band-pass filter is provided outside of a width of an endless member in a longitudinal direction of the endless metal member.

2. An induction heating apparatus according to claim 1, wherein said band-pass filter is a low-pass filter.

3. An induction heating apparatus according to claim 1, wherein said band-pass filter is an RC integration circuit.

4. An induction heating apparatus according to claim 1, wherein said band-pass filter is an RL integration circuit.

5. An induction heating apparatus according to claim 1, wherein said temperature detecting element and said band-pass filter are connected by a twisted cable.

6. An induction heating apparatus according to claim 1, wherein said control means and said band-pass filter are mounted on a power supply circuit board.

7. An induction heating apparatus according to claim 1, wherein each of said high frequency current generating means, said control means and said band-pass filter is mounted on a board, and the board is provided at an outside of the width of the endless member in a longitudinal direction of the endless metal member.

* * * * *

UNITED STATES PATENT AND TRADEMARK OFFICE

CERTIFICATE OF CORRECTION

PATENT NO. : 6,545,255 B2
DATED : April 8, 2003
INVENTOR(S) : Takashi Sato et al.

It is certified that error appears in the above-identified patent and that said Letters Patent is hereby corrected as shown below:

Title page,
Item [57], ABSTRACT,
Line 5, "in accurate" should read -- inaccurate --.
Line 10, "control" should read -- control of --.

Column 2,
Line 1, "source." should read -- source, --.

Column 6,
Line 37, "filed" should read -- field --.

Column 7,
Line 9, "example it is" should read -- example, --.
Line 46, "ends" should read -- ends of --.

Signed and Sealed this

Seventh Day of October, 2003

JAMES E. ROGAN
*Director of the United States Patent and Trademark Office*